US005597187A

United States Patent [19]

Hjorth

[11] Patent Number: 5,597,187

[45] Date of Patent: Jan. 28, 1997

[54] FLOATING LATCHING MECHANISM FOR A SAFE DOOR

[76] Inventor: Terry M. Hjorth, 274 S. 1065 West, Orem, Utah 84058

[21] Appl. No.: 409,466

[22] Filed: Mar. 23, 1995

[51] Int. Cl.[6] ..... E05C 1/02

[52] U.S. Cl. ..... 292/137; 292/3; 292/32; 292/156; 292/DIG. 56

[58] Field of Search ..... 292/32, 35, 156, 292/157, 158, 3, DIG. 73, DIG. 55, DIG. 56, DIG. 51, 137; 16/2

[56] References Cited

U.S. PATENT DOCUMENTS

| | | | |
|---|---|---|---|
| 393,883 | 12/1888 | Brown, Jr. | 292/32 X |
| 1,337,554 | 4/1920 | Harris | 292/32 X |
| 1,744,988 | 1/1930 | Shaw | 292/DIG. 51 X |
| 2,073,149 | 3/1937 | Geyer | 292/DIG. 56 |
| 4,142,747 | 3/1979 | Beck et al. | 292/DIG. 51 X |
| 4,630,330 | 12/1986 | Keller et al. | 16/2 |
| 5,313,997 | 5/1994 | Bias et al. | 16/2 X |

FOREIGN PATENT DOCUMENTS

| | | | |
|---|---|---|---|
| 2044946 | 10/1980 | Germany | 292/35 |

*Primary Examiner*—Rodney M. Lindsey
*Attorney, Agent, or Firm*—Craig S. Barrus

[57] ABSTRACT

This disclosure describes a floating latching mechanism for a safe door. The safe door is secured to the safe box using several pins to latch the door to the safe box. The pins have a connecting end which is slightly smaller in diameter than the hole on the bar. This allows the pin to float on the bar to remedy any misalignment between the pin and the pin support member hole. A bushing is inserted into the pin support member hole to provide a noiseless and maintenance free movement of the pin every time the safe door is latched and unlatched. The floating latching mechanism allows for greatly simplified alignment of pins to the pin support member, and reduces maintenance and noise.

2 Claims, 3 Drawing Sheets

FLOATING LATCHING MECHANISM FOR A SAFE DOOR

BACKGROUND

Gun owners in the United States and elsewhere are concerned with safe storage of their firearms. Their principal concerns are to prevent access of their firearms to members of their own families and friends, and to prevent theft of their firearms. An industry has developed which produces safes which safely store firearms and munitions, as well as preventing theft of firearms. Typically, these safes are fairly large, and have capacity to store several rifles as well as small arms and ammunition. These safes are very heavy, and theft of the firearms would have to include theft of the safe itself.

The safe used to store firearms has a combination lock on the door. If the proper combination is entered, a lever can be moved which retracts several pins simultaneously from the safe box itself into the safe door, allowing the safe door to open. There can be as may as ten or twelve pins around the safe door on the edges, top and bottom. Consequently, when the pins are extended into the safe box, it is impossible to pry the door open and bypass the combination lock. Firearms are thus kept away from children and other unauthorized persons. Thieves find it difficult if not impossible to open the safe or to move it, and so the safe is an effective deterrent to theft.

One of the problems that has been unresolved until this invention is that alignment of the pins within the safe door is very critical and difficult to control during manufacturing. Typically, the pins are welded to a bar inside the safe door. When the bar moves, the pin attached to the bar also moves. Because several pins are attached to the same bar, if the pins are not exactly aligned with the hole in the pin support member, usually one pin supports the weight of the bar and scrapes on the hole as the safe door is latched and unlatched. This wears the pin and its hole excessively, and at the same time produces a loud scraping noise each time the safe is opened or closed.

During manufacturing, the pins are usually welded to the bar. Great care and time, which translates into increased manufacturing costs, need to be taken to ensure perfect alignment of the many pins with their holes. Precise layout of the pins prior to welding is difficult at best. During welding, the uneven application of heat causes warping or deflection of the pin. These deflections cause the pins to be unevenly aligned with the holes which causes binding and scraping each time the safe door is latched or unlatched.

The typical solution is to apply grease to the pin and the hole, but constant application of the grease is necessary as the grease is scraped off during the operation of the safe door. This is a nuisance to and very inconvenient for the safe owner. Another solution is to file either the pin or the hole which results in unsightly and oval holes. This remedy is indicative of poor workmanship which is an immediate deterrent of sales to firearm owners.

For the above reasons, there is a need for a mechanism which allows the pins to float in the door so that perfect alignment of the pins and the holes is unnecessary. This would allow smooth, noiseless operation of the door safe for a maintenance-free lifetime. Manufacturing operations could be greatly simplified without the need of expensive jigs to ensure precise alignment.

SUMMARY

The present invention is directed to a floating latching mechanism for firearm safes, which ensures proper alignment each and every time the safe door is latched and unlatched. In the latched condition the pins are extended through the pin support member on the door to engage the safe door frame, which prevents the safe door from being opened. In the unlatched condition the pins are retracted from the safe door frame into the safe door, which allows the safe door to be opened.

The bar has a hole which is drilled slightly larger, typically about 1/16" (1.6 mm) larger, than the pin connecting end. The pin is secured to the bar by a cotter pin or other means. This allows the pin to float on the bar, which allows the pin to align with its hole in the pin support member. Since many pins are usually attached to the same bar, this floating capability of each pin allows the bar to easily extend and retract the pins without any one pin binding in the pin support member.

The floating latching mechanism eliminates the need to weld the pin to the bar. This eliminates entirely the distortions and deflections which would otherwise cause the pin to bind in the pin support member. This simplifies the manufacturing process and reduces those costs.

A spring washer can be placed around the connecting end between the bar and the pin. This prevents the pins from rattling as the safe door is opened or closed, while yet allowing the pin to float on the bar.

Another key element of this invention is the bushing which is inserted into the hole in the pin support member. While bushing can be made of several different materials, nylon and plastic are perhaps the most common. Up to the present invention, no bushing was used at this location. Consequently, the pin scraped directly on the hole in the pin support member. This causes an annoying noise every time the safe is opened or closed. Additionally, it was critical that grease is applied to this point to reduce the noise and wear. It was particularly difficult, if not impossible, to apply grease to the inside contact point of the pin support member without disassembly of the door.

The bushing has a couple of features which should be noted. The first is a tapered corner which allows for quick and easy insertion into the pin support member. The second is a means for securing the bushing inside the pin support member. One method of securing this bushing is to have deformable wedges near the base which are molded at the same time the bushing is formed. The bushing is placed by hand inside the hole in the pin support member, and a hammer can be used for force the bushing into the hole. This deforms the deformable wedges and locks the bushing inside the hole.

Another means to secure the bushing inside the hole is to form the bushing with two or more fingers. The fingers compress and move toward the center as the bushing is pressed through the hole in the pin support member. When the fingers are extended all the way through the hole in the pin support member, fingers move out again, which allows the lip on the finger to engage the hole and secure the bushing to the pin support member. An advantage of this method is that the bushing can be easily removed and replaced if ever necessary.

BRIEF DESCRIPTION OF THE DRAWINGS

These and other features, aspects and advantages of the present invention will become better understood with regard to the following description, appended claims, and accompanying drawings where:

DESCRIPTION

Figure 1:
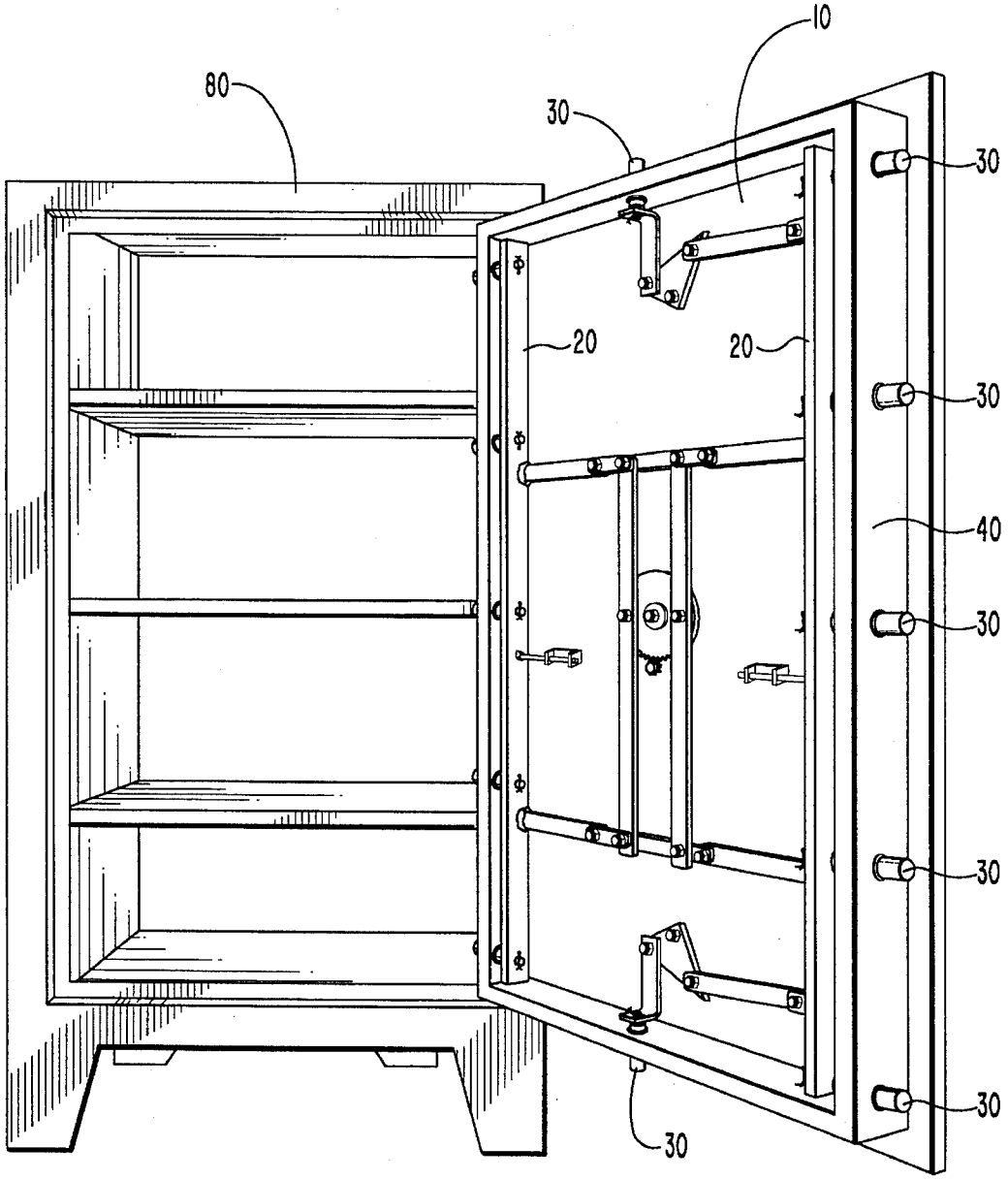
FIG. 1 shows an perspective view of the safe.

FIG. 1 is an isometric view of the invention showing the safe box (80) and the safe door (10). The safe door (10) fits inside the safe box (80) when the safe door (10) is closed. Pins (30) extend from the safe door (10) into the safe box (80) to secure the safe door (10) and prevent the safe door (10) from being opened when latched. Conversely, the pins (30) are retracted into the safe door (10) when the safe door (10) is unlatched, which allows the safe door (10) to swing open.

Figure 2:
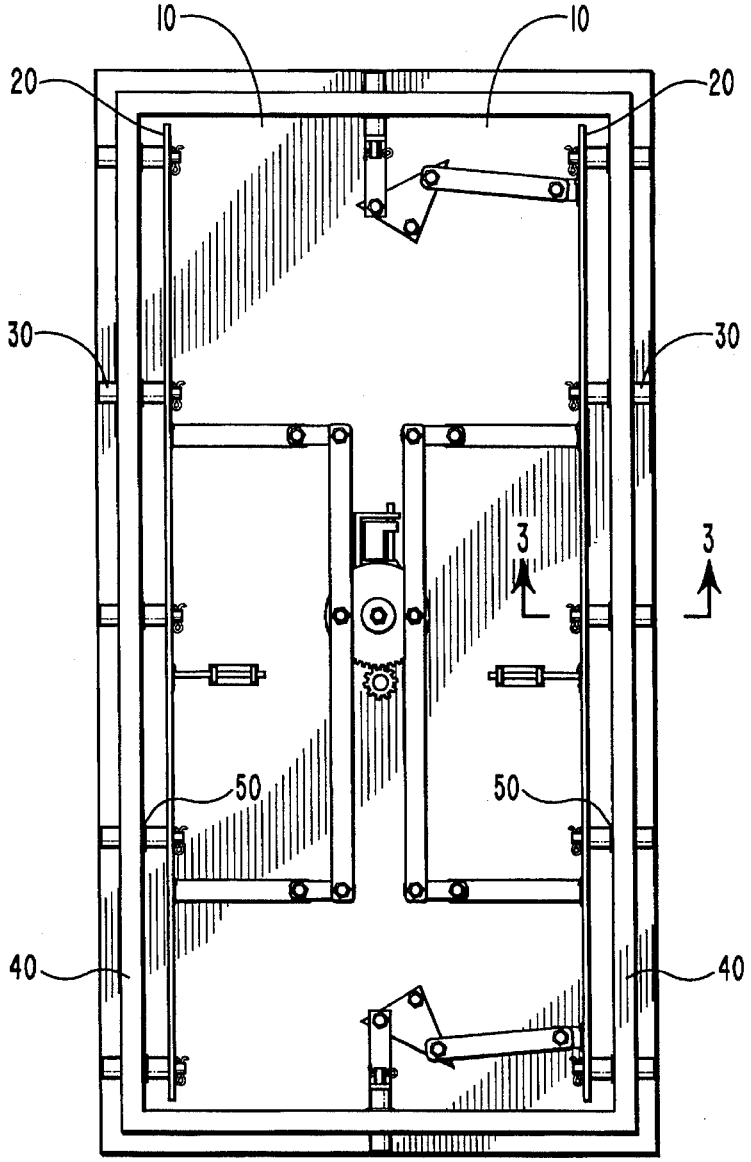
FIG. 2 shows an elevation view of the safe door.

FIG. 2 is an elevation view of the safe door (10) showing the bar (20) and the pins (30) attached to the bar (20). Pins (30) and bars (20) are located around the periphery of the safe door (10). When the pins (30) are extended, the safe door (10) cannot be opened or even pried open. When the pins (30) are retracted, the safe door (10) can easily be opened. Each pin (30) is supported by a pin support member (40) which is mounted to the safe door (10).

Figure 3:
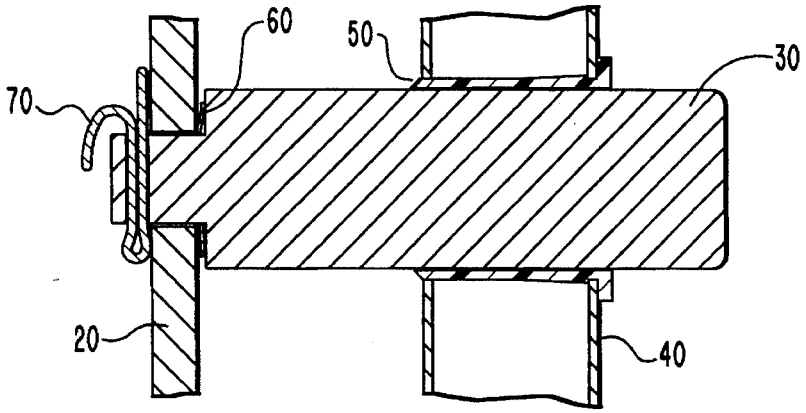
FIG. 3 is a sectional view of the floating latching mechanism.

FIG. 3 is a sectional view of the floating latching mechanism. The bar (20) has a hole which receives the pin (30). The pin (30) is secured to the bar (20) by means of a cotter pin (70). A spring washer (60) between the bar (20) and the pin (30) prevents the pin (30) from excessively moving and rattling. The pin support member (40) has a hole which receives a bushing (50). The pin (30) slides within the bushing (50) and prevents wear and noise when the pin (30) is extended or retracted. As the bar (20) moves, the pin (30) moves in and out of the bushing (50) on the pin support member (40) which latches or unlatches the safe door (10) from the safe box (80).

Figure 4:
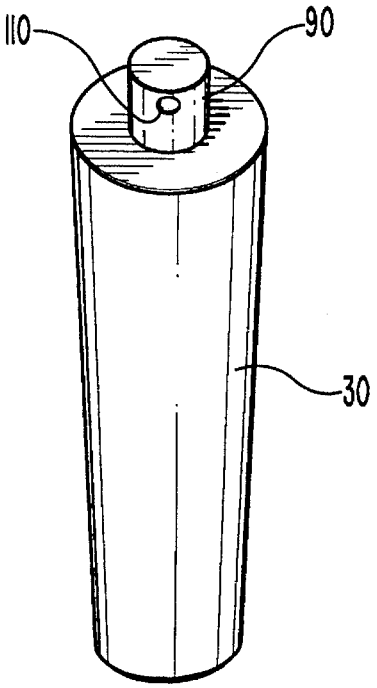
FIG. 4 is a perspective view of the floating latching mechanism.

FIG. 4 is a perspective view of the pin (30). The pin (30) has a connecting end (90). In the connecting end (90) is a cotter pin hole (110).

Figure 5:
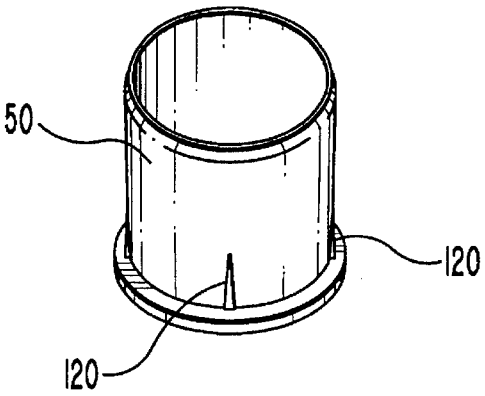
FIG. 5 is a perspective view of the bushing.

FIG. 5 is a perspective view of the bushing (50). The bushing (50) has a tapered corner which allows for easy insertion. Around the bushing (50) are deformable wedges (120) which are located around the circumference of the bushing (50). The deformable wedges (120) deform and secure the bushing (50) to the pin support member (40).

Figure 6:
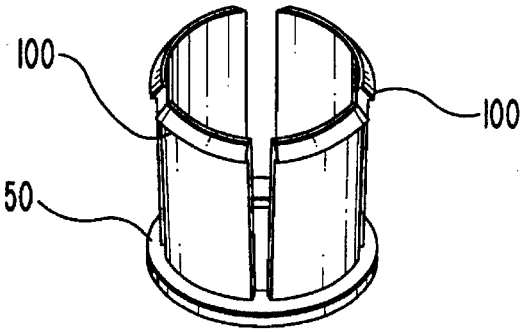
FIG. 6 is a perspective view of an alternative bushing.

FIG. 6 is a sectional view of an alternative configuration of the bushing (50). In this embodiment, the bushing (50) has four fingers (100). As the bushing (50) is pressed through the pin support member (40), the fingers (100) move in toward the center of the bushing (50). When the bushing (50) is seated in the pin support member (40), the fingers (100) extend back to their natural position, which allows the fingers (100) to engage the pin support member (40). This secures the bushing (50) to the pin support member (40). Removal is easily accomplished by compressing the fingers (100) to disengage the bushing (50) from the pin support member (40) and removing the bushing (50).

The present invention, of course, may be carried out in other specific ways other than those set forth above without departing from the scope of the invention. The above embodiments are, therefore, to be considered as illustrative, and the applicant intends only to be limited by the claims appended hereto.

What is claimed is:

1. A floating latching mechanism for a safe door, comprising:

a pin having a connecting end;

a bar movably attached to the connecting end of the pin to retract and extend the pin; and a pin support member having a bushing hole to receive the pin, wherein the bar has a hole greater than the diameter of the connecting end of the pin to receive the connecting end of the pin to allow proper alignment of the pin with the bushing hole.

2. A floating latching mechanism for a safe door as in claim 1, wherein the pin has a cotter pin to moveably attach the pin to the bar.

* * * * *